United States Patent [19]

Boggio

[11] 3,983,024

[45] Sept. 28, 1976

[54] IN-LINE APPARATUS FOR ELECTROPLATING A METAL ONTO AN ARTICLE

[75] Inventor: Robert J. Boggio, Woodridge, Ill.

[73] Assignee: Western Electric Company, Inc., New York, N.Y.

[22] Filed: Feb. 24, 1975

[21] Appl. No.: 552,680

[52] U.S. Cl. ..... 204/198; 204/27; 204/DIG. 7

[51] Int. Cl.[2] ..... C25B 9/00; B01K 1/00

[58] Field of Search ..... 204/198, 222, 224 R, 204/225, 27, 28, DIG. 7, 202–205

[56] References Cited

UNITED STATES PATENTS

| | | | |
|---|---|---|---|
| 2,708,181 | 5/1955 | Holmes et al. | 204/28 |
| 3,521,765 | 7/1970 | Kauffman et al. | 214/17 |
| 3,691,026 | 9/1972 | Durrwachter et al. | 204/28 |
| 3,860,499 | 1/1975 | Graham et al. | 204/15 |
| 3,878,062 | 4/1975 | Grimaldi et al. | 204/15 |

*Primary Examiner*—F.C. Edmundson
*Attorney, Agent, or Firm*—W. G. Dossé

[57] ABSTRACT

To electroplate a metal onto articles having conductive surfaces in an electrolyte bath containing in solution a salt of the metal to be plated onto the articles, a pair of straight, spaced and parallel rails are extended in an essentially horizontal plane along a path from a first point exterior of the plating bath, through the plating bath, and to a second point exterior of the plating bath. Facing slots are formed in the rails, and articles are advanced in tandem within the slots and between the rails along the path from the first to the second points. A plurality of fixed position electrical contactors are positioned to wipingly engage the articles within the plating bath to generate an electrical current between the articles and an anode within the plating bath, and through the plating bath, with the articles functioning as the cathodes to plate the metal onto the articles. Since each article travels the same path through the plating bath and is exposed to the same current densities therein as every other article, uniform plating thicknesses are obtained on the articles.

14 Claims, 3 Drawing Figures

IN-LINE APPARATUS FOR ELECTROPLATING A METAL ONTO AN ARTICLE

BACKGROUND OF THE INVENTION

1. Field of the Invention

The present invention relates to apparatus for electroplating a metal onto a plurality of articles having electrically conductive surfaces, and in particular to an apparatus for exposing each of the articles to the same current densities in an electrolyte plating bath to obtain a uniform plating thickness on the articles.

2. Description of the Prior Art

In the manufacture of certain articles such as electronic circuits or printed wiring boards, a metal is often plated onto electrically conductive surfaces, or selected areas of the surfaces, of the articles. In the case of electronic circuits or printed wiring boards a thin pattern of a conductive material (i.e., titanium and/or palladium) is first formed on one or more surfaces of a substrate, such as a ceramic substrate. The pattern may cover the entire surface, or may define individual circuit paths thereon. The pattern is then plated to a predetermined minimum thickness with a metal, such as copper or gold, to form a conductive layer capable of carrying electrical signals. Plating a metal onto the conductive pattern contemplates immersing the substrates in an electrolyte plating bath containing in solution a salt of the metal to be plated onto the pattern, and applying a voltage between the pattern and an anode within the plating bath to generate a current flow between the pattern and the anode, and through the plating bath, with the pattern as the cathode to plate the metal onto the pattern.

Conventionally, a plurality of substrates are secured within a support rack or plating fixture, a cathodic electrical connection is made with the conductive pattern on the substrates, and the racks with the substrates therewithin are immersed within the plating bath to plate the substrate. With this technique, each substrate within the plating bath is at a different geometric location with respect to the anode therewithin, and the pattern on the substrates are therefore exposed to differing current densities and plating rates. This results in excessive use of the plating metal, since to ensure that a minimum thickness of metal is plated onto each pattern on all of the substrates, thicknesses substantially in excess of the minimum must be plated onto patterns on some of the substrates. When the plating metal is gold, the excessive use thereof adds substantial cost to the plating operation. And while an anode may be geometrically configured to enable all areas of a pattern on a single substrate to be plated to a uniform thickness where one substrate at a time is plated within the plating bath, the savings resulting from minimizing the use of gold would be more than offset by the additional expense of single substrate plating as compared with batch plating.

Another disadvantage of the aforementioned conventional plating technique is that not only the substrates, but also the racks or fixtures for supporting the substrates, must be extended within the plating bath, which increases the risk that contaminants will be introduced into the plating bath requiring disposal or cleansing thereof. Furthermore, frequent manipulation of the fixtures as the substrates are secured therewithin and removed therefrom results in the need for periodic maintenance and repair of the fixtures which, of course, adds expense to the plating operation.

SUMMARY OF THE INVENTION

In accordance with the present invention, an apparatus is provided for electroplating a metal onto an electrically conductive surface of an article which is moved through an electrolyte plating bath, containing in solution a salt of the metal to be plated onto the article, while passing an electric current through the electrolyte and the article with the article functioning as the cathode. A pair of spaced tracks extend through the plating bath and support the moving article therebetween so as to guide the article therealong and through the plating bath. Also included is a contactor for electrically contacting the conductive surface of the article within the plating bath for applying a voltage thereto to supply the electric current to the article to plate the metal onto the article.

More particularly, the article is one of a plurality of planar articles, having a pattern of an electrically conductive material on a surface thereof, and the metal is to be electroplated onto the pattern. An anode is immersed within the plating bath, and the rails are a pair of electrically nonconductive straight tracks extending in an essentially horizontal plane in a spaced and parallel relationship along the path from a first point exterior of the plating bath, through the plating bath, to a second point exterior of the plating bath. The tracks have facing channels formed therein along their length from a third point in proximity with the first point to the second point, and each track has a platform portion extending from the first to the third points and having a surface coextensive with a lower side wall of the channel therein. Together the platforms support opposite edges of successive planar articles positioned thereon and orient the articles for sliding movement therealong toward and into the channels, with each channel receiving an opposite edge of the articles for supporting the article therein and between the tracks. A pusher moves each successive article positioned on the platforms at the first point a predetermined distance toward the second point, at least equal to the length of the article in the direction of travel, to slide the article along the platforms and into the channels. Successive articles moved into the channels engage end to end in series and are pushingly advanced in tandem along the path from the first to the second points, and through the plating bath, with each of the articles advancing along the same path through the plating bath.

A plurality of resilient contactors are secured at fixed positions along at least one of the tracks within the plating bath, and each extend to a fixed point along the path traveled by the articles advancing through the plating bath. The contactors are spaced along the path traveled by the articles a distance apart which is less than the length of the articles in the direction of travel along the path, and are resiliently deflectable from the path by the articles advancing therealong and into wiping electrical engagement with the conductive material patterns on the surfaces of the articles. A voltage is applied between the contactors and the anode, with the contactors as the cathode, to apply a voltage to the conductive pattern on the articles to establish a current flow between the contacted patterns and the anode, and through the electrolyte, with the contacted patterns on the surfaces of the articles as the cathode, to expose the pattern on each article traveling along the same path within the plating bath to the same current densities as the patterns on every other article, and to therefore the same plating rates, to plate a uniform thickness of metal onto the pattern on each article.

DETAILED DESCRIPTION

The drawings illustrate an in-line apparatus for electroplating a metal to a uniform thickness onto a plurality of rigid, planar articles 12 having conductive surfaces, by conveying each article along the same path within a plating bath to expose each article to the same plating current densities. The articles could be, by way of example, ceramic substrates for electronic circuits or wiring boards having a pattern of a conductive material formed on one or both surfaces thereof, onto which a metal is to be electroplated. In the case of ceramic substrates, the conductive material may be a layer of titanium evaporated onto the substrate, onto which an overlying layer of palladium is evaporated.

Figure 1:
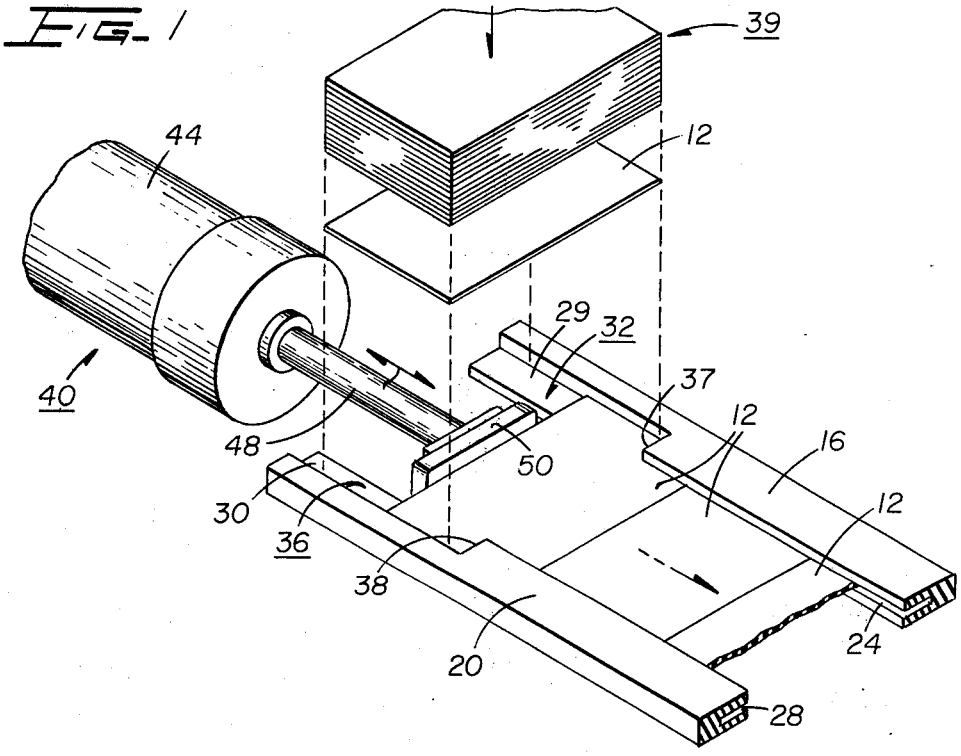
FIG. 1 is an isometric view of the article receiving end of the trackway portion of the invention, and illustrates the manner in which articles to be plated are received between, and advanced along, the trackway.
Figure 2:
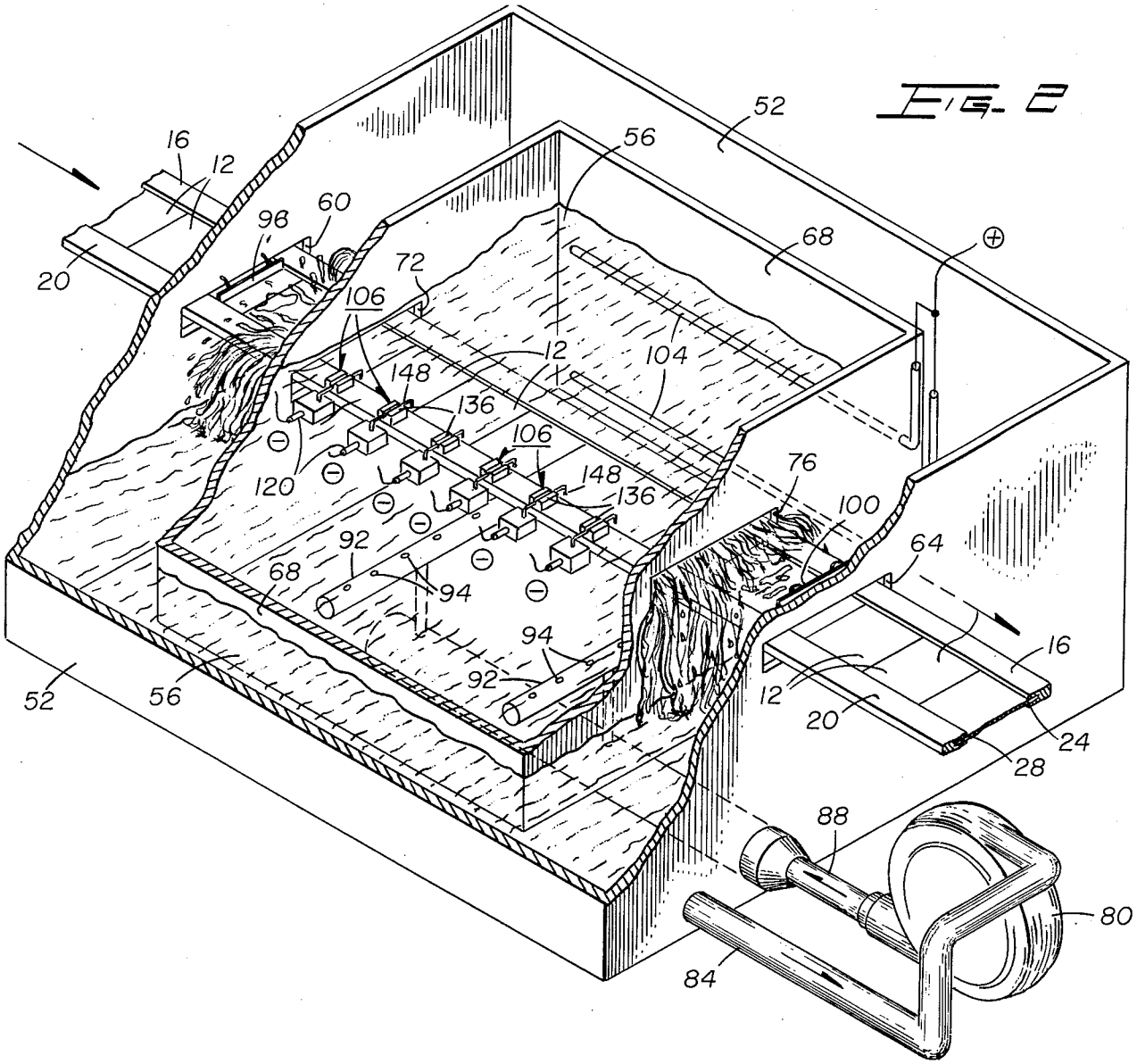
FIG. 2 is an isometric view showing the manner in which articles are conveyed through a plating bath for having a metal plated thereon.

Referring to FIGS. 1 and 2, a pair of straight rails or tracks 16 and 20, of an electrically nonconductive material, are maintained in a spaced and parallel relationship throughout their length by any suitable means, and extend along a path in an essentially horizontal plane from a first point at one end thereof (shown in FIG. 1), through a plating bath (shown in FIG. 2), and to a second point at an opposite end thereof (not shown). The tracks 16 and 20 are configured to support and to guide a plurality of the articles 12 along the path from the first point, through the plating bath, and to the second point.

More particularly, the tracks 16 and 20 have slots or channels 24 and 28, respectively, formed in facing sides thereof along their lengths for accommodating therewithin opposite edges of the articles 12 and for supporting the articles between the tracks for sliding movement therealong. Upper portions of the rails 16 and 20 are removed at the one end thereof to expose the lower side walls 29 and 30 of the slots 24 and 28, respectively, to form a pair of platforms 32 and 36. The platforms 32 and 36 extend from the first point at the one end of the rails 16 and 20 to a third point defined by end edges 37 and 38 of the platforms, and receive opposite edges of successive articles 12 from a supply 39 of the articles.

The surfaces of the platforms 32 and 36 are coextensive with the lower side walls 29 and 30 of the slots 24 and 28, and when an article 12 from the supply of articles 39 is positioned by any suitable mechanism, or by hand, on the platforms 32 and 36, a pusher mechanism 40 is actuated to engage a lagging edge of the article to push the article slidingly along the platforms 32 and 36 and into the slots 24 and 28 a distance at least equal to the length of the article in its direction of travel. This clears the platforms 32 and 36 of the article so that a subsequent article may be positioned thereon, and advances, as wil, be seen, successive articles along and between the rails 16 and 20. The pusher mechanism 40 may be, by way of example, a pneumatic cylinder 44 having a plunger 48 with an article engaging member 50 on the end thereof, oriented to move in the directions shown toward and away from the articles 12 on the platforms 32 and 36 for engaging and pushing the lagging edges of successive articles positioned on the platforms.

As successive articles 12 are positioned, or received, on the platforms 32 and 36, and are pushingly moved along the platforms and within the slots 24 and 28 by the pusher mechanism 40, the articles abut end to end within the slots and between and along the rails 16 and 20. In this manner, movement of each successive article 12 by the pusher mechanism 40 along the platforms 32 and 36 and into the slots 24 and 28 moves, or advances, all of the articles 12 within the slots in tandem between the rails and along the path from the first point, through the plating bath, and to the second point at the opposite end of the rails. It should be noted that since the rails 16 and 20 both support and guide the articles, all of the articles travel along the same path. Preferably, the nonconductive rails are of a low friction material, such as that sold under the tradename Teflon, to facilitate sliding movement of the articles 12 therealong.

Referring now to FIG. 2, the rails 16 and 20, with a plurality of articles 12 supported therebetween and advanced therealong, extend within a reservoir tank 52, for containing a quantity of an electrolyte plating bath 56, through an entrance passageway 60 formed in a first side wall thereof and an exit passageway 64 formed in a second and opposite wall thereof. A plating tank 68, which contains a quantity of the plating bath 56, is positioned within the reservoir tank 52 and the rails 16 and 20 also extend within the plating tank 68 through an entrance passageway 72 formed in a first wall thereof and an exit passageway 76 formed in a second and opposite wall thereof. The electrolyte plating bath 56 within the tanks 52 and 68 may be, by way of example, in the case where the articles 12 are substrates for electronic circuits and the metal to be plated thereon is gold, an acid-gold plating solution containing a salt of gold in a buffered salt aqueous solution. One suitable acid-gold plating solution contemplates the use of potassium-gold-cyanide, $KAu(CN)_2$, as the salt of gold, and dibasic ammonium citrate, $(NH_4)_2HC_6H_5O_7$, as the buffered salt. A suitable concentration for the plating solution is 20 grams $KAu(CN)_2$ and 50 grams $(NH_4)_2HC_6H_5O_7$ per liter of water.

To immerse the articles 12 within the electrolyte plating solution 56 in the plating tank 68, a pump 80 draws the plating solution from the reservoir tank 52 through an inlet line 84, and forces the solution through an outlet line 88 to a pair of sparge tubes 92. The sparge tubes 92 have a plurality of outlet holes 94 formed therein through which the plating solution 56 exits into the plating tank 68 to fill the tank with the solution both above the level of the articles 12 advancing therethrough between and along the rails 16 and 20, and above the upper end of the passageways 72 and 76. The passageways 72 and 76 define open areas in the side walls of the plating tank 68 around the rails 16 and 20 and the articles 12 therebetween, so that plating solution continuously flows through the passageways from the plating tank 68 into the reservoir tank 52 to be recirculated to the plating tank by the pump 80. The quantity of the electrolyte plating solution 56 within the tanks 52 and 68, the cross-sectional area of the passageways 72 and 76, and the rate at which the pump 80 pumps the plating solution from the tank 52 to the tank 68, are selected to maintain the level of the electrolyte plating solution 56 in the plating tank 68 slightly above the upper ends of the passageways 72 and 76. A doctor blade 96 adjacent the passageway 60 in the tank 52, and a doctor blade 100 adjacent the passageway 64 in the tank 52, wipe across the upper surfaces of the articles 12 to prevent the electrolyte plating solution flowing through the passageways 72 and 76 and across the upper surfaces of the articles from exiting through the passageways 60 and 64. If desired, air knives (not shown) could be employed instead of, or in combination with, the doctor blades 96 and 100 to remove the plating solution flowing across the upper surfaces of the articles.

One or more anodes 104 (two of which are shown) are extended into the electrolyte plating bath 56 within the plating tank 68 and have applied thereto a positive voltage from a source of voltage (not shown). To electroplate the metal onto the electrically conductive surface areas, or patterns, of the articles 12, it is necessary that the conductive areas of the articles have a negative voltage applied thereto to establish a current flow between the articles 12 and the anodes 104, and through the electrolyte plating bath 56, with the conductive areas of the articles functioning as the cathodes. It should be understood that reference to positive or negative voltages is for illustration purposes only, and all that is required is that the voltage applied to the anodes 104 be more positive, or less negative, than the voltage applied to the conductive areas of the articles 12.

Figure 3:
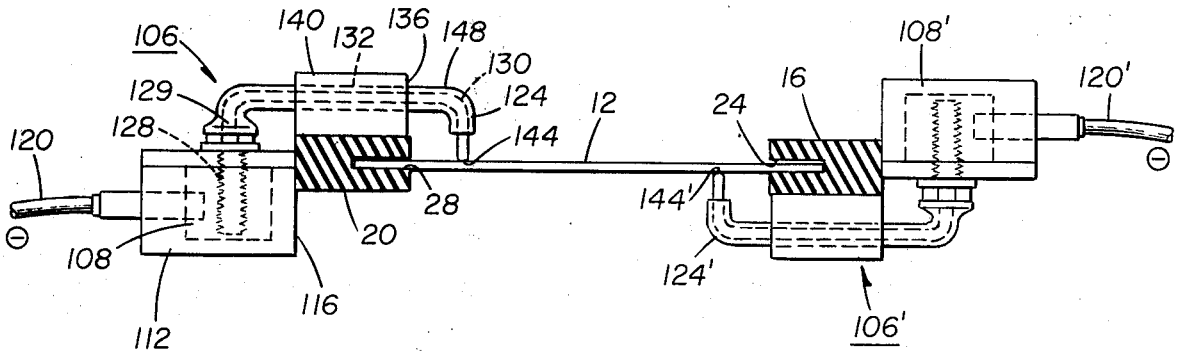
FIG. 3 illustrates, in cross-section, the arrangement of the trackway and contactors within the plating bath of FIG. 2.

Referring to FIGS. 2 and 3, to plate the upper surfaces of the articles 12 a negative voltage is applied to the conductive areas on the upper surfaces thereof through a plurality of resilient wiper contacts 106 secured in a fixed and spaced relationship along the rail 20 within the electrolyte plating bath 56 in the plating tank 68. With particular reference to FIG. 3, each individual one of the contactors 106 includes a bus bar 108 encapsulated within an insulator 112 of a material (i.e., bakelite) which does not react with the plating solution 56. One side 116 of the insulator 112 is secured to an outside edge of the rail 20, and the bus bar 108 receives a negative voltage over an insulated conductor 120 from the voltage supply.

A U-shaped contact 124 of an electrically conductive resilient material (i.e., spring steel) is connected with the bus bar 108 by a threaded extension 128 at an end of one leg 129 thereof, and normally extends at an end of an opposite leg 130 thereof into the path traveled by articles 12 between the slots 24 and 28, and below the upper surfaces thereof. A center portion 132 of the contact 124 is received within a channel 136 formed within a block 140 secured to an upper surface of the rail 20, which limits the lateral movement of the contact 124. Preferably, the resilient contact 124, except for an extreme end portion 144 thereof for electrically engaging the surface of the article 12, is covered along its entire length with an insulator 148 of a material (i.e., bakelite) which does not react with the plating solution. The insulators 112 and 148 completely cover all of the electrically conductive portions of the contactor 106, except for the extreme end portion 144 of the contact 124, and therefore there is no current flow between the anodes 104 and the body of the contactor 106 which would otherwise result in plating occurring on the contactor 106.

With the end 144 of the resilient contact 124 extending slightly below the upper surfaces of articles 12 moving along the path between the slots 24 and 28 and through the plating bath 56, the end 144 of the contact is engaged by a leading edge of a leading article 12 of a succession of articles and deflected upwardly and into forceful wiping engagement with the conductive areas on the upper surface thereof to provide a cathodic voltage to the areas to establish the current flow between the article 12 and the anodes 104, and through the electrolyte plating bath, with the article 12 functioning as the cathode to electrodeposit the metal in the plating solution onto the surface of the article 12. Preferably, the end 144 of the contact 124 is tapered to facilitate upward deflection thereof upon the end 144 being engaged by the leading article 12. Thereafter, the end 144 of the contact 124 slides across the upper surfaces of successive articles 12 advancing in tandem therepast.

In a similar manner, a cathodic plating voltage may be applied to the lower surfaces of the articles 12 with a plurality of contactors 106', which are identical with the contactors 106, secured to the rail 16 within the plating bath to extend the ends 144' of resilient contacts 124' thereof slightly beyond the lower surface of the articles 12 as the articles advance along the path within the bath. In this case, the contacts 124' are deflected downwardly by the leading edge of the leading article 12 and into forceful wiping engagement with the conductive areas on the lower surface thereof to apply the cathodic voltage thereto and to the lower surfaces of successive articles. In a preferred embodiment of the invention, both the contactors 106 and the contactors 106' are employed, and a negative voltage is selectively applied over one or both of the insulated conductors 120 and 120' to selectively plate the upper surfaces, the lower surfaces, or both the upper and the lower surfaces of the articles 12. Also, while each contactor 106 and 106' is shown as receiving a voltage through an individual bus bar 108 or 108', the bus bars 108 and 108' could just as readily be elongated bus bars which extend along the length of their associated rails within the plating bath, each for applying a voltage to all of the contactors 106 or 106' associated therewith.

Preferably, although not necessarily, the spacing of the contactors 106 and 106' along the tracks 16 and 20 within the plating bath 56, and therefore the spacing of the ends 144 and 144' of the contacts 124 and 124' along the path traveled by the articles 12 within the plating bath 56, is less than the length of the articles in their direction of travel. This ensures that at least one of the contactors 106 and 106' electrically engages an associated upper or lower surface of each of the articles 12 at all times within the plating bath 56 to continuously apply a cathodic voltage thereto while the article is within the plating bath.

It should be noted that each article 12 travels through the plating bath 56 within the plating tank 68 along a path defined by the stationary rails 16 and 20. In other words, each article 12 travels along the same path through the plating bath 56 as every other article 12, is electrically engaged by each contactor 106 or 106' as is every other article 12, has a current flow established therebetween and between the same anodes 104 as does every other article 12, and is therefore exposed to the same current densities during its travel through the plating bath 56 as is every other article 12. Since the current density to which an article is exposed within a plating bath determines the plating rate, and since each of the articles 12 within the plating bath 56 is exposed to the same current densities, each article 12 has plated thereon a uniform thickness of metal.

The plating thickness obtained on each article 12 is, within limits, determined by the potential difference between the voltage applied by the contactors 106 and 106' to the articles 12 and the voltage applied to the anodes 104, which, of course, controls the strength of the current density to which the articles are exposed. Also determinative of the plating thickness is the rate of passage of the articles 12 through the plating solution 56 within the tank 68, and therefore the time that the articles 12 are within the plating solution and exposed to the plating voltages. This plating time is determined by the rate at which the articles 12 are introduced onto the platforms 32 and 36 of the rails 16 and 20 for being moved therealong, and within the slots 24 and 28, by the pusher mechanism 40. Accordingly, the plating thickness obtained on the articles 12 may be controlled both by the voltage between the contactors 106 and 106' and the anodes 104, and by the rate at which articles 12 are introduced, from the supply of articles, within the slots 24 and 28 and between the rails 16 and 20. It should be noted that recirculation of the electrolyte plating solution 56 between the tanks 52 and 68 continuously mixes the solution and prevents spent plating solution from accumulating in the vicinity of the articles 12, which spent plating solution would otherwise cause nonuniformities in the plating thicknesses obtained on the articles.

After being plated within the electrolyte plating bath 56 within the plating tank 68, the articles advance along and between the tracks 16 and 20 out of the plating bath 56 through the passageway 76, out of the reservoir tank 52 through the passageway 64, and to the second point (not shown) at the end of the rails whereat the articles are removed from between the rails by hand or by any suitable mechanism. It should be noted that since the rails 16 and 20 and the contactors 106 and 106' always remain in the plating bath 56, and that only the articles 12 to be plated are introduced within the plating bath, the danger of contaminating the plating bath by accidentally introducing foreign matter therein is minimized, which danger would be much greater if fixtures for supporting the articles within the plating bath were also continuously moved into and out of the plating bath.

While one particular embodiment of the invention has been described in detail, it is understood that various other modifications and embodiments may be devised by one skilled in the art without departing from the spirit and scope of the invention.

What is claimed is:

1. In an apparatus for electroplating a metal onto an electrically conductive surface of an article moving through an electrolyte plating bath containing in solution a salt of the metal to be plated onto the article, by passing an electric current through the electrolyte and the article with the article functioning as a cathode:

a pair of spaced tracks extending through the plating bath, for supporting and for guiding the moving article therealong and through the plating bath, and means for electrically contacting the conductive surface of the article within the plating bath and for applying a voltage thereto to supply the electric current to the article to plate the metal onto the article.

2. In an apparatus as set forth in claim 1, wherein the electrically contacting means includes at least one electrical contactor secured at a fixed position along one of the tracks within the plating bath for engaging the conductive surface of the article within the bath to supply the electric current thereto.

3. An electroplating apparatus according to claim 1, wherein the electrolyte plating bath comprises:

an electrolyte reservoir tank for containing a quantity of electrolyte and having above the level of the electrolyte an entrance passageway and an exit passageway for transmission therethrough of the pair of spaced tracks;

means for minimizing the flow of electrolyte through the entrance passageway and the exit passageway of the reservoir;

a plating tank within the reservoir, having an entrance passageway and an exit passageway aligned with the entrance passageway and exit passageway of the reservoir, for transmission therethrough of the pair of spaced tracks; and means for maintaining the level of electrolyte inside the plating tank above the pair of spaced tracks and the entrance passageway and exit passageway in the plating tank.

4. In an apparatus for electroplating a metal onto electrically conductive surfaces of a plurality of articles moving through an electrolyte plating bath which contains in solution a salt of the metal to be plated onto the article surfaces:

a pair of stationary and spaced rails extending along a path from a first point exterior of the plating bath, through the plating bath, and to a second point exterior of the plating bath, for supporting therebetween and in series therealong a plurality of the articles and for guiding successive moving articles along the path from the first point, through the plating bath, and to the second point, and means for establishing an electric current flow through the electrolyte and the conductive surfaces of the successive articles within the electrolyte with the surfaces of the articles functioning as a cathode to plate the metal onto the articles.

5. In an apparatus as set forth in claim 4, wherein the electric current establishing means includes a plurality of electrical contactors secured at fixed positions along at least one of the rails within the electrolyte plating bath and spaced one from the other along the path a distance which is less than the length of an article guided along the path, each for wipingly engaging the conductive surface of an article guided therepast and for applying a voltage thereto to establish the current flow.

6. An electroplating apparatus according to claim 4, wherein the electrolyte plating bath comprises:

an electrolyte reservoir tank for containing a quantity of electrolyte and having above the level of the electrolyte an entrance passageway and an exit passageway for transmission therethrough of the pair of stationary rails;

means for minimizing the flow of electrolyte through the entrance passageway and the exit passageway of the reservoir:

a plating tank within the reservoir, having an entrance passageway and an exit passageway aligned with the entrance passageway and exit passageway of the reservoir, for transmission therethrough of the pair of stationary rails; and means for maintaining the level of electrolyte inside the plating tank above the pair of stationary rails and the entrance passageway and exit passageway in the plating tank.

7. In an apparatus for electroplating a metal onto a plurality of planar articles having electrically conductive surfaces, in an electrolyte plating bath containing in solution a salt of the metal to be plated onto the articles and having a stationary anode immersed therein:

a pair of straight, spaced and parallel rails extending along a path from a first point exterior of the plating bath, through the plating bath, to a second point exterior of the plating bath, having facing slots formed therein along their length from the first to the second points, for receiving within the slots at the first point opposite edges of successive articles and for supporting the articles therebetween and in series therealong;

means for advancing the successive articles received within the slots in tandem along the path, within the slots, and between the rails from the first point, through the plating bath, and to the second point, to convey each article through the plating bath along the same path therewithin as every other article, and means at fixed points within the plating bath along the path traveled by the articles advancing therethrough for electrically contacting the conductive surface of each article advancing therepast and for applying a voltage thereto to establish a current flow between the contacted articles and the anode, and through the electrolyte, with the contacted articles functioning as a cathode, to expose each article traveling through the plating bath to the same current densities as every other article, and to therefore the same plating rates, to plate a uniform thickness of metal onto each article.

8. In an apparatus for electroplating as set forth in claim 7, wherein the means for electrically contacting each article includes:

a first plurality of electrically common resilient contactors secured at fixed positions along one of the rails within the plating bath, each contactor of the first plurality extending at an end thereof to a point in the path traveled by the articles within the plating bath, and resiliently deflectable therefrom by the articles traveling therepast and into wiping electrical engagement with a first conductive surface of each of the articles, and a second plurality of electrically common resilient contactors secured at fixed positions along the other one of the rails within the plating bath, each contactor of the second plurality extending at an end thereof to a point in the path traveled by the articles within the plating bath, and resiliently deflectable therefrom by the articles traveling therepast and into wiping electrical engagement with a second and opposite conductive surface of each of the articles.

9. In an apparatus as set forth in claim 8, wherein the contactors of the first plurality are spaced one from the other along the one rail a distance apart which is less than the length of an article traveling along the path so that the first surface of each article is continuously electrically contacted within the plating bath, and wherein the contactors of the second plurality are spaced one from the other along the other one of the rails a distance apart which is less than the length of an article traveling along the path so that the second surface of each article is continuously electrically contacted within the plating bath.

10. An electroplating apparatus according to claim 7, wherein the electrolyte plating bath comprises:

an electrolyte reservoir tank for containing a quantity of electrolyte and having above the level of the electrolyte an entrance passageway and an exit passageway for transmission therethrough of the pair of straight rails;

means for minimizing the flow of electrolyte through the entrance passageway and the exit passageway of the reservoir;

a plating tank within the reservoir, having an entrance passageway and an exit passageway aligned with the entrance passageway and exit passageway of the reservoir, for transmission therethrough of the pair of straight rails; and means for maintaining the level of electrolyte inside the plating tank above the pair of straight rails and the entrance passageway and exit passageway in the plating tank.

11. In an apparatus for electroplating a metal onto a plurality of planar articles having a pattern of an electrically conductive material formed on a surface thereof in an electrolyte plating bath containing in solution a salt of the metal to be plated onto the articles:

an anode immersed in the plating bath;

a pair of electrically nonconductive straight tracks extending in an essentially horizontal plane in a spaced and parallel relationship along a path from a first point exterior of the plating bath, through the plating bath, to a second point exterior of the plating bath, the tracks having facing channels formed therein along their length from a third point in proximity with the first point to the second point, and each track having a platform portion extending from the first to the third points and having a surface coextensive with a lower side wall of the channel therein, the platforms together supporting opposite edges of successive planar articles positioned thereon and orienting the articles for sliding movement therealong toward and into the channels with each channel receiving an opposite edge of the articles for supporting the articles therewithin and between the tracks;

means for pushing each successive article positioned on the platforms at the first point a predetermined distance toward the second point, at least equal to the length of the article in the direction of travel, to slide the article along the platforms and into the channels, to engage successive articles moved into the channels end to end in series, and to pushingly advance the articles in tandem along the path from the first to the second points, and through the plating bath, with each of the articles advancing along the same path through the plating bath;

a plurality of resilient contactors, each extending to a fixed point along the path traveled by the articles advancing through the plating bath, and each resiliently deflectable from the path by the articles advancing therealong and into wiping electrical contact with the conductive material patterns on the surfaces of the articles, and means for applying a voltage between the contactors and the anode with the contactors as the cathode to apply a voltage to the patterns on the articles with the contactors to establish a current flow between the contacted patterns and the anode, and through the electrolyte, with the contacted patterns on the articles functioning as the cathode to expose the patterns on each article traveling along the same path within the plating bath to the same current densities as the patterns on every other article, and to therefore the same plating rates, to plate a uniform thickness of metal onto the pattern on each article.

12. In an apparatus as set forth in claim 11, wherein the electrical contactors are secured at fixed positions along at least one of the tracks within the plating bath a distance apart which is less than the length of the articles in the direction of travel along the path, so that each article is continuously electrically contacted within the plating bath.

13. An electroplating apparatus according to claim 11, wherein the electrolyte plating bath comprises;

an electrolyte reservoir tank for containing a quantity of electrolyte and having above the level of the electrolyte an entrance passageway and an exit passageway for transmission therethrough of the pair of straight tracks;

means for minimizing the flow of electrolyte through the entrance passageway and the exit passageway of the reservoir;

a plating tank within the reservoir, having an entrance passageway and an exit passageway aligned with the entrance passageway and exit passageway of the reservoir, for transmission therethrough of the pair of straight tracks; and means for maintaining the level of electrolyte inside the plating tank above the pair of straight tracks and the entrance passageway and exit passageway in the plating tank.

14. In an apparatus for electroplating an article:

a first container having a pair of aligned openings in opposed walls;

a second container surrounding the first container and having a pair of aligned openings in opposed walls which are aligned with the aligned openings in the first container;

a pair of spaced tracks of non-conductive material extending through both pairs of aligned openings;

means for incrementally advancing an article along said track and through both said containers;

means for electrically contacting said article following each incremental advancement; and means for circulating a predetermined quantity of electrolyte from the second container into the first container to maintain the tracks submerged, through the opposed openings in said first container, and back into the second container said predetermined quantity being such that the track sections extending between the first and second containers are above the level of the electrolyte in the second container.

* * * * *